United States Patent [19]

Varin

[11] 3,954,073

[45] May 4, 1976

[54] SPOOL CARRIER ADAPTOR FOR A CHILD'S SEWING MACHINE

[75] Inventor: Claude Varin, Voiron, France

[73] Assignee: The Singer Company, New York, N.Y.

[22] Filed: Aug. 2, 1974

[21] Appl. No.: 494,266

[52] U.S. Cl. ..... 112/259
[51] Int. Cl.[2] ..... D05B 43/00
[58] Field of Search ..... 112/169, 259, 218 R; 242/130, 134, 136

[56] References Cited

UNITED STATES PATENTS

| | | | |
|---|---|---|---|
| 475,511 | 5/1892 | Miller | 242/134 |
| 849,140 | 4/1907 | La Bate | 242/134 |
| 1,034,832 | 8/1912 | Plaatje | 242/136 |
| 1,514,767 | 11/1924 | Hill | 242/130 |
| 2,220,969 | 11/1940 | List et al. | 242/134 |
| 2,686,484 | 8/1954 | Cuthberson | 242/130 |
| 3,444,833 | 5/1969 | Blackwood et al. | 242/134 |
| 3,656,443 | 4/1972 | Ross | 112/158 B |

FOREIGN PATENTS OR APPLICATIONS

| | | | |
|---|---|---|---|
| 1,019,151 | 11/1957 | Germany | 112/169 |

*Primary Examiner*—Werner H. Schroeder
*Assistant Examiner*—Conrad L. Berman
*Attorney, Agent, or Firm*—Chester A. Williams, Jr.; Edward L. Bell; Marshall J. Breen

[57] ABSTRACT

A child's sewing machine having a frame including a work-supporting bed, a vertical standard projecting upwardly therefrom adjacent one end of said bed, a hollow bracket arm extending horizontally from said standard longitudinally above the bed and terminating in a sewing head, said bracket arm having a through aperture formed therein adapted to accommodate a veriical spool pin providing rotatable support for a thread supply for a thread carrying needle, said frame further carrying stitch sewing instrumentalities including a thread carrying needle. An adapter plate is secured to the bracket arm and has provision for a horizontal spool pin thereon and an upstanding thread guide.

1 Claim, 4 Drawing Figures

SPOOL CARRIER ADAPTOR FOR A CHILD'S SEWING MACHINE

BACKGROUND OF THE INVENTION

Children's sewing machines have enjoyed wide use heretofore. In many cases such machines are constructed primarily to resemble the sewing machines employed by adults. A principal objective has been to produce a sewing machine which would have popular market appeal stemming from a child's basic desire to emulate the parents. Through the years, however, such machines have undergone substantial modification to the point where today they are capable of thread concatenation to produce a seam in much the same manner as a standard adult household machine. Public acceptance of such machines has increased over the years until today there is a substantial market for them. The primary motivation for the child in desiring these machines remains the desire to emulate the parent. It has not always been possible to incorporate in the child's machine, due to cost limitations, the latest advances in design and function which have evolved in connection with the development and modernization of the household machine. Yet, in order to maintain the high level of interest in such machines it is important that the child's machine resemble the adult's household machine as closely as possible both aesthetically and functionally.

As is well known to persons skilled in the art of sewing machine manufacture, improvements in thread handling techniques have led to the replacement of the heretofore used vertical spool pin for mounting of the supply of needle thread by the horizontal spool pin in many instances. It has been found, for example, that the unwinding of the thread axially from a horizontally mounted spool, and the orientation of the unwound thread via an axially arranged thread guide, enhances the feeding of the thread to the needle for the stitch forming process. This feature has, therefore, been widely adopted for adult household machines. However, significant numbers of children's machines have already been produced which have lost a certain degree of marketability because they were manufactured to accommodate the previously conventional vertical spool pin. The need exists, therefore, for a simple, inexpensive manner of converting such existing machines so that they resemble in appearance the adult horizontal spool pin machines and are nevertheless functional.

SUMMARY OF THE INVENTION

It is, in view of the foregoing, a principal object of this invention to provide a child's sewing machine converted from use with a vertical spool pin to use with a horizontal spool pin.

Another object of the invention is the simple, economical conversion of a child's sewing machine from use with a vertical spool pin to use with a horizontal spool pin through the employment of a suitable adapter plate. These and other objects and advantages of the invention will become readily apparent from the ensuing description of the invention.

According to the present invention there is provided a child's sewing machine having a frame including a work-supporting bed, a vertical standard projecting upwardly therefrom adjacent one end of said bed, a hollow bracket arm extending horizontally from said standard longitudinally above said bed and terminating in a sewing head, stitch forming instrumentalities carried in said frame and including a thread carrying needle endwise reciprocable in said sewing head, said bracket arm having a through aperture formed therein adapted to accommodate a vertical spool pin providing rotatable support for a thread supply for said thread carrying needle, an adapter plate having an undersurface shaped complemental to at least a portion of said bracket arm adjacent to said through aperture, means for securing said adapter plate in overlying relation complemental to said portion of said bracket arm, said adapter plate being provided adjacent one end thereof with a pedestal having a horizontal spool pin thereon providing support for a thread supply for said thread carring needle, and said adapter plate being provided adjacent the other end with an upstanding thread guide.

BRIEF DESCRIPTION OF THE DRAWINGS

In order that the invention may be more fully comprehended it will now be described, by way of example, with reference to the accompanying drawings in which.

DETAILED DESCRIPTION OF THE INVENTION

Figure 1:
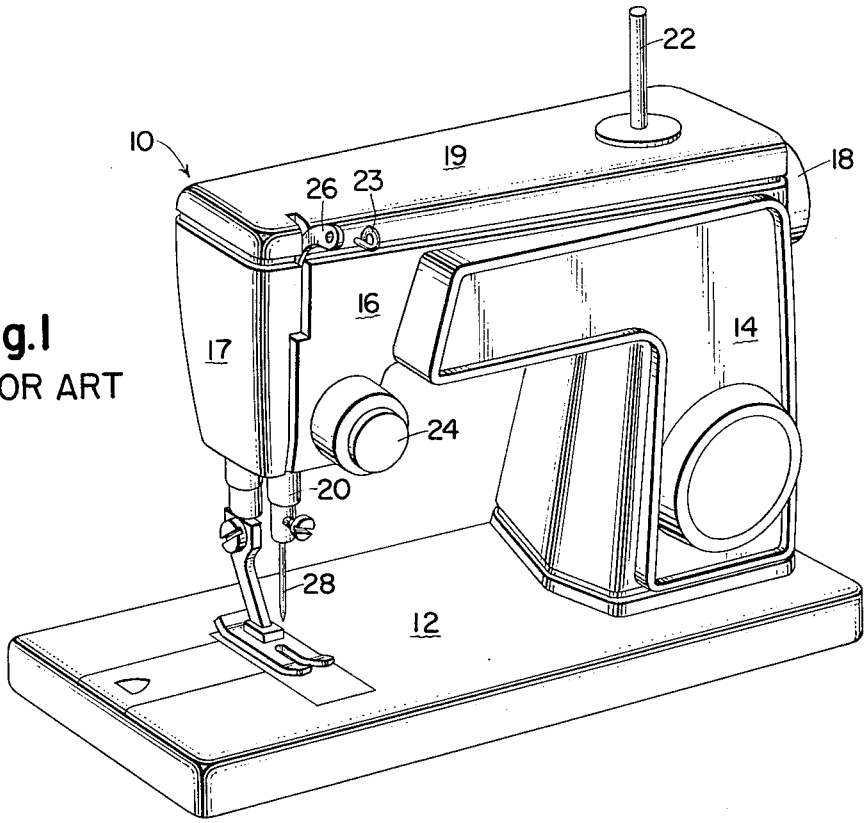
Fig.1 PRIOR ART
FIG. 1 is a perspective view of a child's sewing machine equipped with a vertical spool pin as is common in the prior art.
Figure 4:
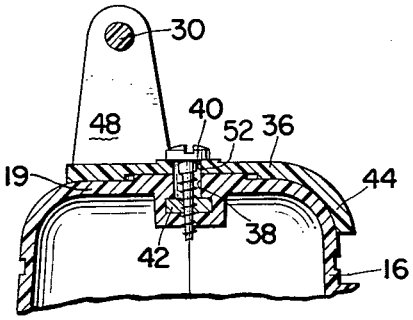
FIG. 4 is a sectional view of the top cover plate and adapter plate taken along line 4—4 of FIG. 2.
Figure 2:
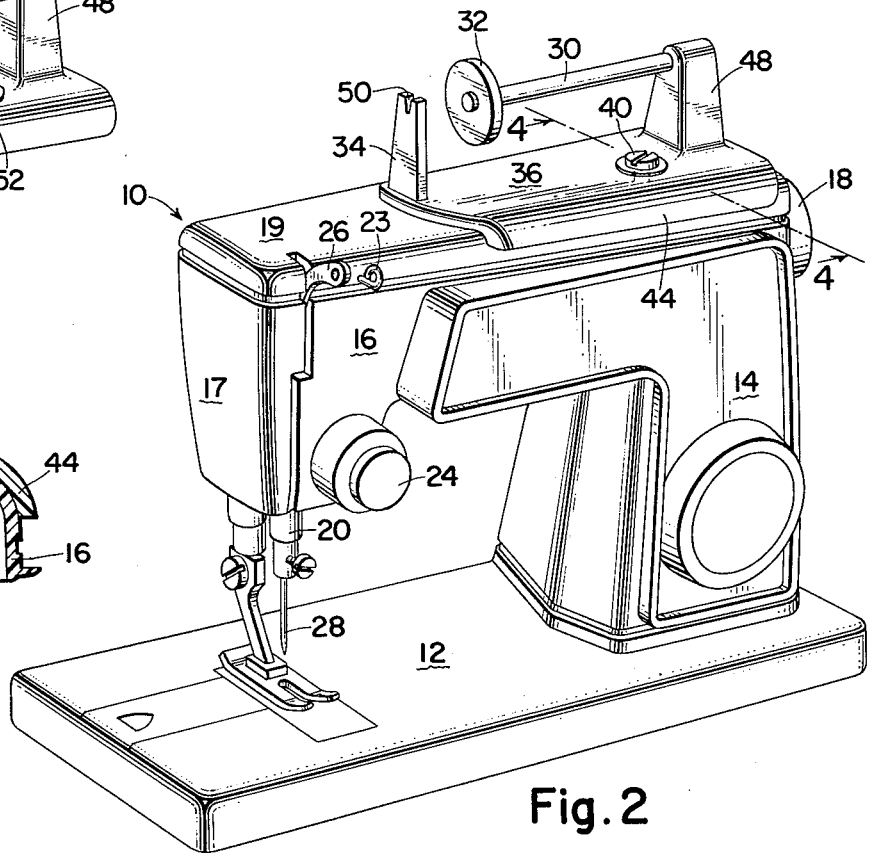
FIG. 2 is a perspective view of the child's sewing machine shown in FIG. 1 modified to accommodate a horizontal spool pin in accordance with the present invention.

Referring to the drawing, particularly FIGS. 1 and 2 thereof, there is shown a child's sewing machine 10 which comprises a frame including a work-supporting bed 12 from which a vertical standard 14 projects upwardly adjacent one end. A hollow horizontal bracket arm 16 extends longitudinally of the bed from the standard and terminates in sewing head 17. A top closure 19 closes the open upper portion of the bracket arm. Such top closure may be a separate element or it may be constructed as part of the bracket arm. For example, as shown by FIG. 4, the machine may be formed in complementary halves, such as by molding, and then assembled into the completed unit to house the operating mechanism therewithin. Drive means, not shown, including a main drive shaft, are generally mounted within the bracket arm. One end of the drive shaft is connectable with either manual driving means, such as hand wheel 18 which may be provided conveniently with a handle that is not shown, or through appropriate gearing with an electric motor that would normally be situated within the vertical standard. It is to be understood, of course, that the specific drive means for effectuating the movement of the needle bar 20 and the needle 28 carried thereby in order to form the stitches is a matter of choice and does not form part of the present invention.

The end of the drive shaft remote from hand wheel 18 is operatively connected to the needle bar, and the drive shaft is also operatively connected to a looptaker, not shown, through its own drive means located generally in the bed 12 of the machine.

As shown in FIG. 1, the machine as originally manufactured is provided with a vertical spool pin 22 for the mounting thereon of a spool containing a supply of needle thread which is unwound and directed to a thread tensioning means 24, take-up 26 and thence to the needle 28. FIG. 2 depicts the machine modified to provide a horizontal spool pin 30, spool retaining means 32, and thread guide 34 all carried by an adapter plate 36.

Reference to FIG. 4 will show that an aperture 38 is formed in the top closure of the sewing machine dimensioned to receive vertical spool pin 22 in the machine as originally constructed. When converting the machine for use with a horizontal spool pin it has been found expeditious to utilize the same aperture for the reception of fastening means such as screw 40 to secure the adapter plate 36 to the top closure. It will be observed from FIG. 4 that an insert 42 may be employed to threadably receive the desired fastening means.

Figure 3:
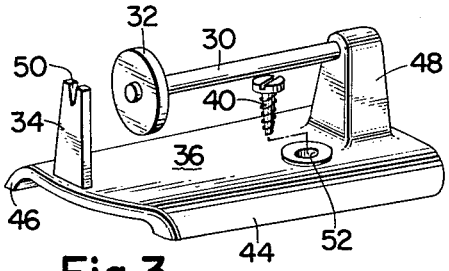
FIG. 3 is a perspective view of a modified form of adapter plate.

The adapter plate 36 is formed so as to be positionable over the top closure of the original machine with its bottom surface in close overlying relation to the upper surface of the top closure. The adapter plate may be substantially planar except for a longitudinally extending front edge 44 thereof which depends downwardly in close conformity with the underlying surface of the top closure. As shown by FIG. 3 the adapter plate may, if so desired, be formed with similar depending longitudinally extending front and rear edges 44, 46, the distance between such edges preferably being such as to enable the adapter plate to be snapped into plate onto the top closure. In such event the use of fastening means, such as screw 40, may be obviated.

The adapter plate, as stated previously, is given an upright pedestal 48 which is provided with horizontal spool pin 30 adapted to receive thereon a spool of thread (not shown). The spool is retained on the spool pin by retaining means 32. The pedestal may be formed integrally with the adapter plate, particularly when the adapter plate is molded from a plastic material. Also carried by the adapter plate, and formed integrally therewith, if desired, is upstanding thread guide 34, the thread being unwound axially from the spool and directed through notch 50 of the thread guide and thence to a thread guide 23, the thread tensioning means 24, the take-up 26 and to the needle 28.

From the foregoing it will be seen that the invention provides for the simple conversion of a child's sewing machine from one adapted for use with a vertical spool pin to one utilizable with a horizontal spool pin. This enables enhancement of the marketability of such machines by an easy, inexpensive conversion of such machines through the use of the adapter plate disclosed herein and the mere removal of the vertical spool pin originally fitted to the machine. The adapter plate is provided with an aperture 52 which, when the adapter plate is positioned in place upon the top closure of the machine, is in alignment with the aperture 38 in the top closure through which the vertical spool pin previously projected.

Numerous alterations of the structure herein disclosed will suggest themselves to those skilled in the art. However, it is to be understood that the present disclosure relates to a preferred embodiment of my invention which is for purposes of illustration only and not to be construed as a limitation of the invention. All such modifications which do not depart from the spirit of the invention, are intended to be included within the scope of the appended claims.

Having thus set forth the nature of the invention, what is claimed herein is:

1. An adaptor device for converting a sewing machine having an overall appearance, a major portion of which is contributed to by the shape of the sewing machine frame bracket arm, to an overall appearance of a different shape; said sewing machine bracket arm including front and rear sidewalls and a top cover having an exposed contour non-planar surface plating into said sidewalls, said adaptor device adapted to be mounted on top of said bracket arm top cover and having a bracket arm engaging surface complemental to the non-planar contour of the exposed surface of the bracket arm top cover and including at least one depending edge, including a single screw for securing said adaptor device on said bracket arm and cooperating with said bracket arm engaging surface of the adaptor device to lock it in fixed position on said bracket arm; a pedestal provided on said adaptor device and having secured thereto a spool pin; thread spool retaining means on said spool pin; and a thread guide mounted on said adaptor device and disposed in substantial alignment with the axis of the spool pin and in spaced relation to said single securing screw so that lateral forces applied to the thread guide will impart turning moments in said adaptor device about the axis defined by said single securing screw, said single screw being located on said adaptor device opposite a point intermediate the ends of said at least one depending edge so that turning movement of the adaptor device about the fastening screw in either direction will be opposed by said at least one depending edge.

* * * * *